US005836395A

United States Patent [19]

Budde

[11] Patent Number: 5,836,395

[45] Date of Patent: Nov. 17, 1998

[54] VALVE FOR WELLBORE USE

[75] Inventor: Peter Budde, Vlaardigen, Netherlands

[73] Assignee: Weatherford/Lamb, Inc., Houston, Tex.

[21] Appl. No.: 868,511

[22] Filed: Jun. 4, 1997

Related U.S. Application Data

[63] Continuation-in-part of Ser. No. 639,886, Apr. 29, 1996, Pat. No. 5,680,902, which is a continuation-in-part of Ser. No. 519,503, Aug. 25, 1995, Pat. No. 5,511,618, which is a continuation of Ser. No. 283,404, Aug. 1, 1994, Pat. No. 5,450,903.

[51] Int. Cl.[6] ..... E21B 33/04

[52] U.S. Cl. ..... 166/321; 166/324; 175/218

[58] Field of Search ..... 166/321, 324–326; 175/218

[56] References Cited

U.S. PATENT DOCUMENTS

| | | | |
|---|---|---|---|
| 1,490,848 | 4/1924 | Pettit | 137/519.5 |
| 1,577,740 | 3/1926 | Macomber et al. | 137/519.5 |
| 1,700,603 | 1/1929 | Vreeland et al. | 137/519.5 |

(List continued on next page.)

FOREIGN PATENT DOCUMENTS

| | | |
|---|---|---|
| WO 89/09869 | 3/1989 | WIPO . |
| WO 96/07009 | 8/1995 | WIPO . |

OTHER PUBLICATIONS

Weatherford, "Cementing Program," 1986.

Weatherford, "General Services And Products Catalog," 1990–91.

Weatherford, "AF — SURE — SEAL Technical Bulletin HOU, 123 –001," 1986.

Weatherford, "Model 820 Float Valves Technical Bulletin HOU 115 –001," 1994.

Weatherford, "Model 457 Float Valves Technical Bulletin HOU 114 –001," 1984.

Davis–Lynch, Inc. "In Floating And Cementing Equipment," 1984 –85.

Baker Packers, "Bakerline Float Equipment & Cementing Aids," 1989.

Trico Industries, Inc. "1982 –1983 Catalog," 1982.

Baker Oil Tools, "Primary Cementing," 1989.

Baker Oil Tools, Inc. "Bakerline Stage And Stab–In Cementing Equipment And Services," 1982.

Int'l Search Report; Int'l Appln. PCT/EP95/00987 (counterpart of present application 08/519,503).

"1982–83 Products & Services Catalog," Weatherford Int'l, pp. 39–43.

(List continued on next page.)

*Primary Examiner*—Roger Schoeppel
*Attorney, Agent, or Firm*—Guy McClung

[57] ABSTRACT

A new valve has been invented, in some aspects useful in wellbore operations and/or as a mud saver valve which valve has a body through which fluid is flowable, a valve seat connected in and to the body and through which fluid is flowable, a valve member positioned adjacent the valve seat and selectively movable to seat against the valve to close the valve to fluid flow and selectively movable away from the seat to open the valve to fluid flow, and at least one recess on the valve member for holding debris and thereby preventing the debris from inhibiting valve closure. A new valve has been invented useful as stated above with a body through which fluid is flowable, a valve seat connected in and to the body and through which fluid is flowable, a valve member positioned adjacent the valve seat and selectively movable to seat against the valve to close the valve to fluid flow and selectively movable away from the seat to open the valve to fluid flow, and at least one recess on the valve seat for holding debris and thereby preventing the debris from inhibiting valve closure. Wellbore methods and operations have been invented using a valve as described above, which method in one aspect includes operation of a circulating head and wherein the valve is a mud saver valve assembly.

17 Claims, 5 Drawing Sheets

U.S. PATENT DOCUMENTS

| | | | |
|---|---|---|---|
| 1,863,613 | 6/1932 | Burt . | |
| 1,872,855 | 8/1932 | Walker | 166/153 |
| 1,875,414 | 9/1932 | Burt . | |
| 1,882,314 | 10/1932 | Burt | 166/328 |
| 1,906,312 | 5/1933 | Burt | 137/533.11 |
| 2,075,882 | 4/1937 | Brantley | 166/21 |
| 2,104,270 | 1/1938 | Owsley | 166/1 |
| 2,162,261 | 6/1939 | Layne | 166/21 |
| 2,309,839 | 2/1943 | Gardner | 137/519.5 |
| 2,320,670 | 6/1943 | Scaramucci | 166/328 |
| 2,627,314 | 2/1953 | Baker et al. | 166/1 |
| 2,630,179 | 3/1953 | Brown | 166/14 |
| 2,654,435 | 10/1953 | Oliver | 166/4 |
| 2,724,443 | 11/1955 | Baker . | |
| 2,748,873 | 6/1956 | Baker et al. | 166/327 X |
| 2,756,828 | 7/1956 | Daily | 166/164 |
| 2,802,482 | 8/1957 | Arnhold . | |
| 2,884,938 | 5/1959 | Hildebrandt | 137/68 |
| 2,935,131 | 5/1960 | McCune | 166/45 |
| 3,006,415 | 10/1961 | Burns et al. | 166/156 |
| 3,062,296 | 11/1962 | Brown | 166/225 |
| 3,102,595 | 9/1963 | Fisher et al. | 166/156 |
| 3,105,378 | 10/1963 | Darling | 73/40.5 |
| 3,153,451 | 10/1964 | Chancellor et al. | 166/51 |
| 3,159,219 | 12/1964 | Scott | 166/156 |
| 3,273,650 | 9/1966 | Alexander et al. | 166/327 X |
| 3,332,499 | 7/1967 | Harris et al. | 166/242 |
| 3,385,370 | 5/1968 | Knox et al. | 166/225 |
| 3,385,372 | 5/1968 | Knox | 166/225 |
| 3,545,543 | 12/1970 | Kammerer, Jr. et al. | 166/212 |
| 3,581,817 | 6/1971 | Kammerer, Jr. | 166/208 |
| 3,698,426 | 10/1972 | Litchfield et al. | 166/325 X |
| 3,738,436 | 6/1973 | Litchfield et al. | 166/379 X |
| 3,759,281 | 9/1973 | Falcuta | 137/519.5 |
| 3,768,556 | 10/1973 | Baker | 166/154 |
| 3,770,001 | 11/1973 | Davis | 137/533.11 |
| 3,776,250 | 12/1973 | Knox | 137/71 |
| 3,776,258 | 12/1973 | Dockins, Jr. | 137/519.5 |
| 3,847,372 | 11/1974 | Litchfield | 175/218 X |
| 3,877,529 | 4/1975 | Litchfield | 175/65 |
| 3,965,980 | 6/1976 | Williamson | 166/224 R |
| 3,967,680 | 7/1976 | Jeter | 166/325 X |
| 4,067,358 | 1/1978 | Streich | 137/624.13 |
| 4,082,104 | 4/1978 | Keeney | 137/71 |
| 4,130,166 | 12/1978 | Akkerman et al. | 166/324 |
| 4,262,693 | 4/1981 | Giebeler | 137/494 |
| 4,364,407 | 12/1982 | Hilliard | 175/218 X |
| 4,372,391 | 2/1983 | Barrington et al. | 166/373 |
| 4,413,682 | 11/1983 | Callihan et al. | 166/382 |
| 4,417,600 | 11/1983 | Kohn | 175/218 X |
| 4,421,179 | 12/1983 | Boyadjieff | 173/44 |
| 4,429,746 | 2/1984 | Allard | 166/291 |
| 4,442,894 | 4/1984 | Callihan et al. | 166/328 X |
| 4,449,596 | 5/1984 | Boyadjieff | 175/85 |
| 4,474,241 | 10/1984 | Freeman | 166/317 |
| 4,487,263 | 12/1984 | Jani | 166/289 |
| 4,488,566 | 12/1984 | Hicks | 137/74 |
| 4,515,218 | 5/1985 | Bissonnette | 166/328 |
| 4,529,045 | 7/1985 | Boyadjieff et al. | 173/164 |
| 4,535,968 | 8/1985 | Gano et al. | 251/58 |
| 4,589,495 | 5/1986 | Langer et al. | 166/383 |
| 4,603,710 | 8/1986 | Tiefenthaler | 137/514.7 |
| 4,605,077 | 8/1986 | Boyadjieff | 175/85 |
| 4,624,316 | 11/1986 | Baldridge et al. | 166/325 |
| 4,625,755 | 12/1986 | Reddoch | 166/325 X |
| 4,625,762 | 12/1986 | Hasanzdeh et al. | 137/624.27 |
| 4,655,247 | 4/1987 | Westra et al. | 137/519.5 |
| 4,674,569 | 6/1987 | Revils et al | 166/154 |
| 4,687,019 | 8/1987 | Mayfield | 137/375 |
| 4,711,300 | 12/1987 | Wardlaw, III et al. | 166/153 |
| 4,712,619 | 12/1987 | Stepp et al. | 166/327 |
| 4,825,947 | 5/1989 | Mikolajczyk | 166/241 |
| 4,872,510 | 10/1989 | Lehr et al. | 166/327 |
| 4,945,947 | 8/1990 | Westra | 137/519.5 |
| 4,955,949 | 9/1990 | Bailey et al. | 166/325 X |
| 4,962,819 | 10/1990 | Bailey et al. | 166/325 X |
| 4,979,562 | 12/1990 | Langer | 166/242 |
| 4,997,042 | 3/1991 | Jordan et al. | 166/379 |
| 5,178,184 | 1/1993 | Skillman | 137/533.13 |
| 5,228,518 | 7/1993 | Wilson et al. | 166/369 |
| 5,261,488 | 11/1993 | Gullet et al. | 166/241.7 |
| 5,348,351 | 9/1994 | LaFleur et al. | 285/110 |
| 5,364,004 | 11/1994 | Carlson et al. | 166/326 X |
| 5,509,442 | 4/1996 | Claycomb | 137/494 |
| 5,577,566 | 11/1996 | Albright et al. | 175/321 |

OTHER PUBLICATIONS

"Float Equipment by Weatherford," Weatherfrod Oil Tool Co., Ltd.

"Used Float Shoe Recovered And Tested," Colvard, 10 Feb. 1986 Oil & Gas Journal.

"Flow Loop Endurance Tests Compare Float Performance," Stringfellow, 10 Feb. 1986 Oil & Gas Journal.

"Tests Find hammering, Fluid, Cutting, Erosion Cause Float Shoe Failures," Stringfellow, 21 Jan. 1985 Oil & Gas Journal.

"Product Catalog Oilfield Service Solutions," Weatherford Int'l, particularly pp. 15–17, 1992.

"Conventioanlized and Specialized Float Equipment," Weatherfrod Int', 1895.

VALVE FOR WELLBORE USE

RELATED APPLICATIONS

This is a continuation-in-part of U.S. application Ser. No. 08/639,886 filed Apr. 29, 1996 entitled "Wellbore Valve," now U.S. Pat. No. 5,680,902 which is a continuation-in-part of application 08/519,503 filed Aug. 25, 1996, now U.S. Pat. No. 5,511,618, which is a continuation of 08/283,404 filed Aug. 1, 1994, now U.S. Pat. No. 5,450,903

BACKGROUND OF THE INVENTION

1. Field of the Invention

This invention is directed to valves, to float valves for use in wellbores, and to mud saver or check valves useful with wellbore mud circulating systems.

2. Description of Related Art

The prior art discloses a variety of valves that have a valve body through which fluid is flowable and a movable valve member that selectively seats against a seat member to control fluid flow through the valve body.

During the construction of oil and gas wells a borehole is drilled to a certain depth. The drill string is then removed and casing inserted. The annular space between the outside of the casing and the wall of the borehole is then conditioned for cementing by pumping conditioning fluid down the casing. The conditioning fluid flows radially outwardly from the bottom of the casing and passes upwardly through the annular space (or vice versa) where it entrains debris and carries it to the surface. Finally, cement is pumped downwardly through the casing, squeezes radially outwardly from the bottom of the casing and passes upwardly into the annular space where it sets.

Conventionally a fill valve or "float valve" is fitted on the bottom of the casing or close to the bottom. The fill valve inhibits fluid entering the casing from the bore but permits fluid to flow from the casing into the borehole. The fill valve is normally incorporated in a float shoe or a float collar, a float shoe being fitted on the bottom of the casing while a float collar is incorporated between two lengths of casing. The rate at which casing can be lowered into a wellbore is limited by the resistance of fluid in the bore. Various proposals have been made to increase the rate at which the casing can be lowered down the bore. One common solution is to pump mud into the casing as it is lowered. This solution is very effective and various devices have been designed to facilitate the introduction of mud into the top of the casing.

One of the problems which can arise when lowering casing is that the casing may stick. This problem is particularly apparent when lowering casing down deviated bores. If the casing sticks the usual procedure is to "circulate" the mud. This involves pumping mud down the casing under pressure and allowing it to flow back to the surface in the annular space between the outside of the casing and the bore. Generally, circulating will free any minor obstruction and allow the running of the casing into the bore to be continued.

It will be appreciated that for the purposes of running casing the mud is simply allowed to flow into the casing while, for circulation, the top of the casing is sealed so that the interior of the casing can be pressurized, typically from 100 to 300 bar.

One device for use in running and circulating is the known prior art LaFleur Autoseal Circulating Head. In use, mud is introduced into the casing via a flexible mud supply hose generally referred to as a "fill tube" while casing is being run. In certain aspects it is necessary to remove the fill tube each time a stand of casing has to be added t the casing string. Conventionally the fill tube is pivoted to one side of the drill string while the new stand is moved into place. Incorporated fully herein by reference for all purposes is U.S. application Ser. No. 08/755,128 filed Nov. 22, 1996 entitled "Circulating Head" and the prior art booklet "LaFleur Petroleum Services, Inc. Autoseal Circulating Head"(copy attached).

In order to inhibit mud dropping onto the working platform and making it very slippery and dangerous, a "mud saver valve" is provided at the lower end of the fill tube.

Typical mud saver apparatuses are connected below a kelly and shut off drilling mud flow when mud pumps pumping the mud are turned off. The apparatus opens automatically when the mud pumps are again turned on. U.S. Pat. No. 4,262,693 discloses a kelly valve with a ball valve rotatably mounted in a tubular housing with a plurality of movable sleeves and a gear drive for controlling fluid flow through a kelly. These publications also disclose prior art mud saver apparatuses: "Mud Check (™) Kelly Valve Cuts Waste of Time, Mud," OIL AND GAS JOURNAL, Feb. 20, 1978; "Drilco Mud-Check (™) Kelly Valve", Drilco Division of Smith International, Inc.; "Swaco Mud Saver Valve", Swaco Division Dresser Industries, Inc.; "Break It Clean With Aitco's Mud Saver Valve", American International Tool Co., Inc.; "Introducing The Compact A–Z Mud Saver Valve", A–Z International Tool Company; "Kellyguard Bulletin 6601", Hydril Mechanical Products Division, 1981; "Make Dry Connections Automatically With The Mud Saver (™), "Arrowhead Continental.

Certain known mud saver valves have several disadvantages. In particular, several of them employ metal to metal seals which are rapidly eroded by the abrasive flow of mud rendering the valves non-sealing. In addition, they are mounted in a length of rigid tubing the inner wall of which rapidly erodes, particularly during circulation. In various prior art assembly grit or debris lodged between valve parts or in valve parts, e.g. between a valve member and a valve seat, prevents closing of the valve.

SUMMARY OF THE PRESENT INVENTION

The present invention, in certain aspects, discloses a valve with a valve body through which fluid is flowable, the valve body having a valve seat secured thereto or formed integrally thereof; a valve member adjacent the valve body and selectively movable away from the valve seat to open the valve to fluid flow and selectively movable to seat against the valve seat to close the valve to fluid flow; and the valve member has one or more recesses therearound defining a fin (or fins) portion therebetween to facilitate sealing of the valve member against the valve seat. In one aspect the valve seat is tapered or conical and the valve member has a corresponding taper or conical shape.

In certain embodiments a valve member and valve seat as described above are used, according to this invention, in a mud saver valve or in a float valve. In an alternative embodiment the valve seat has the one or more recesses and the valve member has a flat surface that contacts and co-acts with the "finned" valve seat. In another aspect, both the valve seat and the valve member each have one or more fins defined by one or more recesses. It is also within the scope of this invention to employ only one recess in the valve member and/or in the valve seat.

The present invention, in certain aspects, discloses a valve with a valve body through which fluid is flowable, the valve body having a valve seat secured thereto or formed integrally thereof; a valve member adjacent the valve body and selectively movable away from the valve seat to open the valve to fluid flow and selectively movable to seat against the valve seat to close the valve to fluid flow; and the valve member has at least one recess therearound defining a space into which debris or other undesirable material may move so that such debris etc. does not inhibit proper and complete closure of the valve. In one aspect the valve seat is tapered or conical and the valve member has a corresponding taper or conical shape.

In certain embodiments a valve member and valve seat as described above are used, according to this invention, in a mud saver valve or in a float valve. In an alternative embodiment the valve seat has the one or more recesses and the valve member has a flat surface. In another aspect, both the valve seat and the valve member each have one or more such recesses. It is also within the scope of this invention to employ only one recess in the valve member and/or in the valve seat.

The present invention discloses, in certain embodiments, a valve with a body through which fluid is flowable, a valve seat connected in and to the body and through which fluid is flowable, a valve member positioned adjacent the valve seat and selectively movable to seat against the valve to close the valve to fluid flow and selectively movable away from the seat to open the valve to fluid flow, and at least one recess on the valve member for holding debris and thereby preventing the debris from inhibiting valve closure; such a valve wherein the at least one recess is positioned near and end of the body defining a fin and the body is made of flexible material so the fin is flexible to enhance sealing of the valve member against the valve seat; any such valve wherein the at least one recess is a plurality of spaced apart recesses; any such valve wherein at least one fin is defined between two adjacent recesses and the body is made of flexible material so the at least one fin is flexible to enhance sealing of the valve member against the valve seat; any such valve wherein the valve is a mud saver valve; and any such valve in combination with a circulating head.

The present invention discloses, in certain embodiments, a valve with a body through which fluid is flowable, a valve seat connected in and to the body and through which fluid is flowable, a valve member positioned adjacent the valve seat and selectively movable to seat against the valve to close the valve to fluid flow and selectively movable away from the seat to open the valve to fluid flow, and at least one recess on the valve seat for holding debris and thereby preventing the debris from inhibiting valve closure; such a valve wherein the at least one recess is a plurality of spaced apart recesses, wherein the valve is a mud saver valve, and further comprising a circulating head in combination with the valve.

The present invention discloses, in certain embodiments, a wellbore method or operation using any valve described herein and such a method including operation of a circulating head and wherein the valve is a mud saver valve assembly as described herein.

It is, therefore, an object of at least certain preferred embodiments of the present invention to provide:

New, useful, unique, efficient, nonobvious devices and methods for valves, mud saver valves, and float valves;

Such a valve in which a valve seat or a valve member has one or more recess encircling it;

Such a valve in which two or more such recesses define one or more fin areas on the valve seat and/or on the valve member;

Such a valve in which the seat is tapered and receives and co-acts with a corresponding tapered surface (which may include edge surfaces of one or more fins) on a valve member;

A valve with at least one debris, grit, dirt, and/or material catching/retaining recess that partially encircles or completely encircles either a valve seat or a valve member selectively movable against and away from the seat or both; and Such a valve with both one or more flexible fins and one or more debris, etc. holding recesses.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1A:
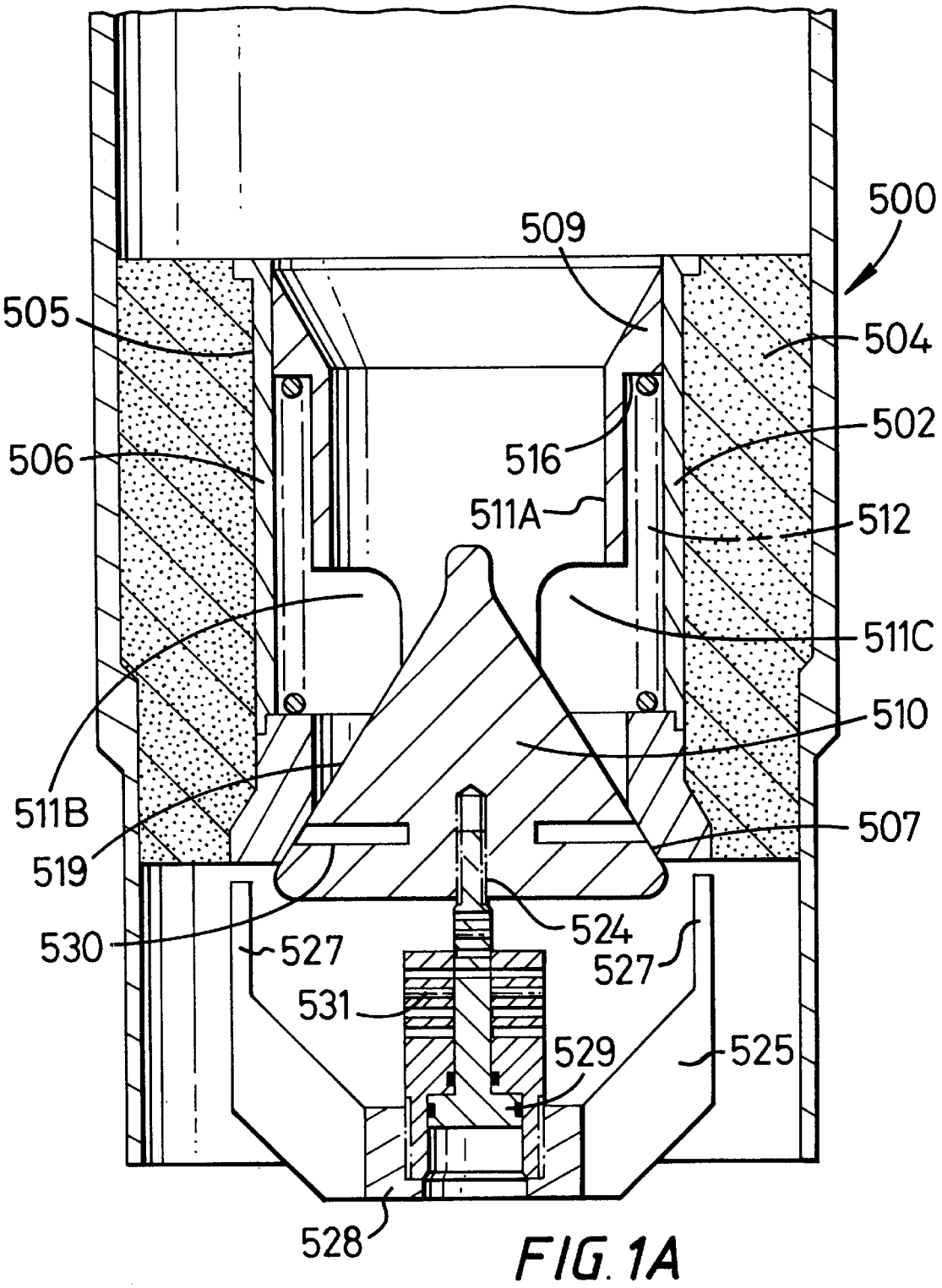
FIG. 1A is a side cross-section view of a valve according to the present invention.
Figure 10:
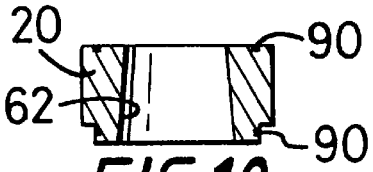

FIG. 1A shows a fill valve 500 according to the present invention which is like the fill valve in FIG. 10 of U.S. Pat.

No. 5,450,903 and in U.S. application Ser. No. 08/639,886 (both co-owned with the present invention and incorporated here in their entirety), but with a recess 530 encircling a head 510 and opening adjacent a valve seat 507. In one aspect, the head 510 is made of resilient material (e.g. somewhat flexible rubber, plastic, polyurethane, etc. that permits some flexing so that a lower portion of the head 510 subjected to fluid pressure may flex due to the presence of the recess 530 to enhance the sealing effect of the head 510 against the valve seat 507. In another aspect the head 510 is rigid (e.g. made of rigid plastic, metal, e.g. stainless steel, e.g. SS316) and the recess or recesses 530 are used to hold debris that might otherwise inhibit proper and complete seating of the valve member against the valve seat. The head 510 of a valve member 509 is provided with a threaded bore 524 into which is screwed an attachment 525. The attachment 525 comprises a spider having four legs 527 which radiate outwardly from a hub 528. A bolt 529 extends through the hub 528 and is screwed into the threaded bore 524. When lowering a string of casing into a wellbore it is sometimes desirable to be able to allow liquid from the wellbore to flow into the casing at a controlled rate. For this purpose a shear pin 530 is first inserted through a bore extending through the hub 528 and the bolt 529. The hub 528 is then rotated so that the bolt 529 enters the threaded bore 524. Rotation is continued until the attachment 525 bears against the valve seat 507 and the fill valve is opened by the desired amount. Fluid flows through windows 511B and 511C in a tubular portion 511A of the valve member 509. A spring 512 abuts a top flange 516 and a top of the valve seat 507. In use, the valve member 509 is opened by the desired amount and the casing lowered down the wellbore. When the pressure on the bottom of the head 510 of the valve member 509 reaches a predetermined level the shear pin 530 breaks and the fill valve closes.

During a cementing operation the valve member 509 is displaced downwardly in the previously described manner to allow fluid to pass through the valve 502.

It is within the scope of this invention to use one or more recesses 530 on any valve member disclosed in U.S. Pat. No. 5,450,903 or on any known valve member of any valve used in any wellbore operations or of any known float or fill valve.

Figure 1B:
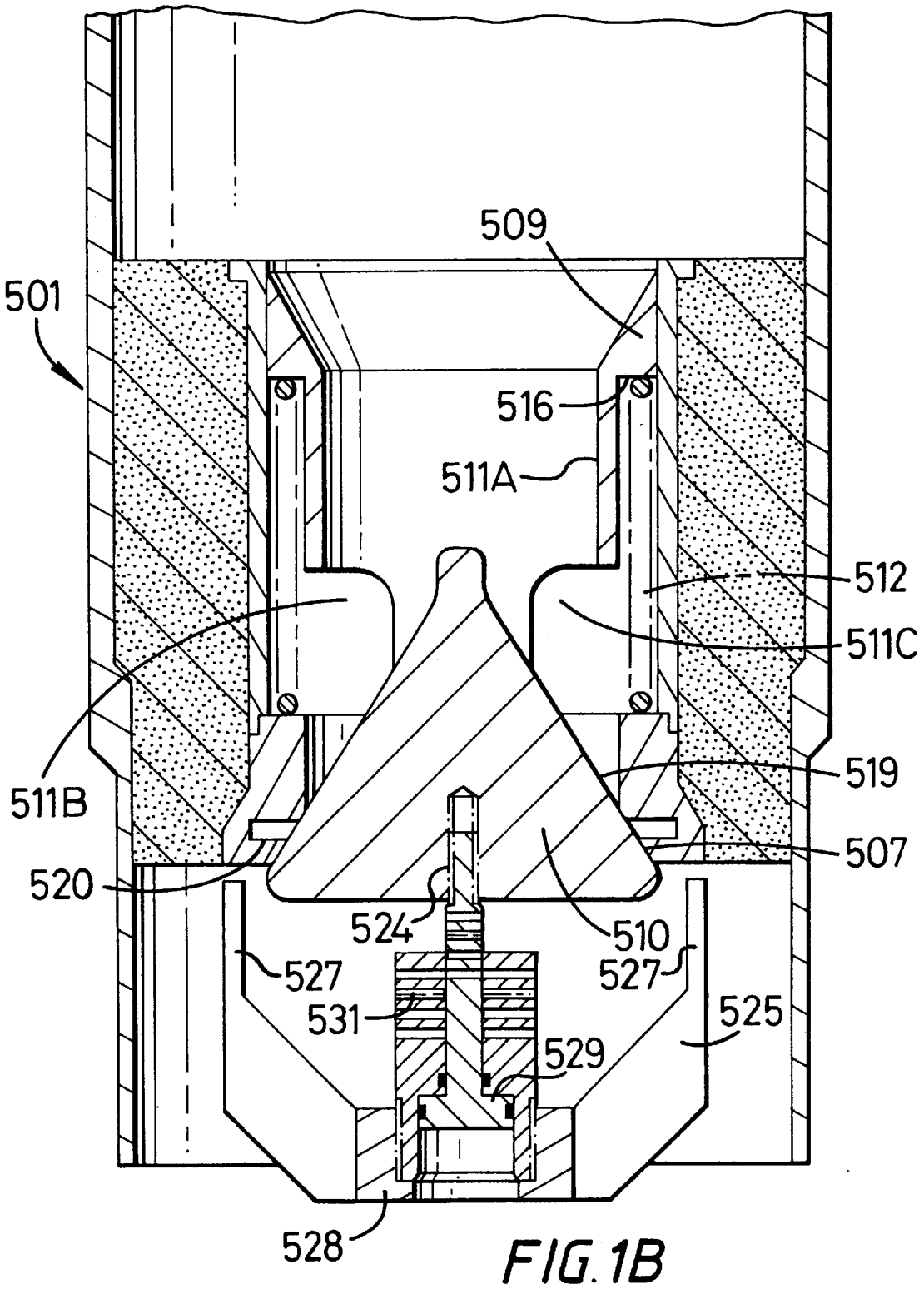
FIG. 1B is a side cross-section view of a valve according to the present invention.

FIG. 1B shows a float valve 501 like the float valve 500, FIG. 1A (and the same numerals denote the same parts), but without the recess 530. The valve seat 207 does have a recess encircling it for holding debris and/or for facilitating sealing in a manner similar to that in which the recess 530 operates. Fluid pressure on the head 510 pushes it against the valve seat 207 and parts of the valve seat 207 flex in response to the pressure due to the presence of the recess 520. The seat 207, in one aspect, is made of suitable material (e.g. but not limited to plastic or polyurethane) to allow flexing of its lower portion.

Figure 2:
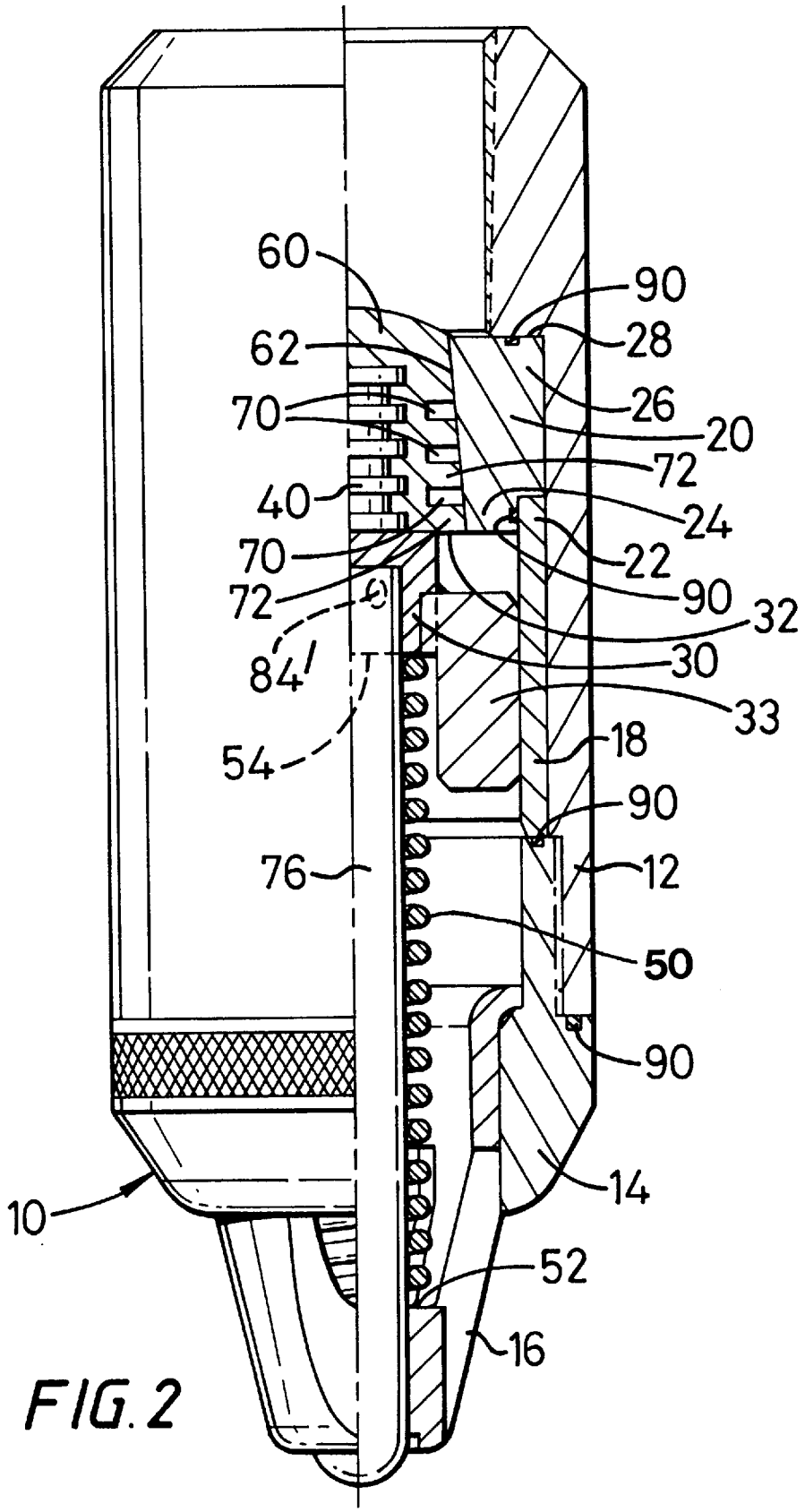
FIG. 2 is a side cross-section view of a valve according to the present invention.
Figure 7:
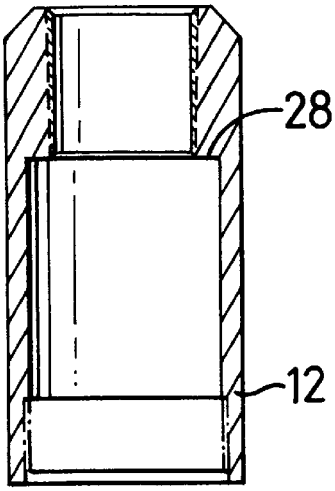
FIGS. 3A, 4A, 5, 6A, 7, 8, 9 and 10 are side cross-section views of parts of the valve assembly of FIG. 2.

FIG. 2 shows a mud saver assembly 10 according to the present invention which has a hollow sub body 12 (made, e.g. of polyurethane or stainless steel or plastic or steel) to which a nose guide 14 is threadedly mated. A spring retainer 16 is held in place in the nose guide 14 by a spring 50. Lock screws 83 hold the nose guide 14 in place. A wear housing 18 is secured within the sub body 12 with an end 22 held between the interior wall of the sub body 12 and a portion 24 of a valve seat 20.

The valve seat 20 has a top 26 that abuts on a shoulder 28 of the sub body 12.

A piston guide 30 is secured to or formed integrally with an end 32 of a piston 40. The piston guide 30 has a plurality of stabilizing vanes 33 that guide the piston's movement within the wear housing 18.

A spring 50 biased against an inner shoulder 52 of the spring retainer 16 and against a bottom 54 of the piston guide 30 initially holds the piston 40 and a polyurethane valve member 60 against a seat surface 62 of the valve seat 20. When fluid pressure on the top of the valve member 60 exceeds the force of the spring 50, the valve member 60 moves away from the valve seat 20 (downwardly in FIG. 2) to open the valve assembly 10.

The spring 50 is positioned around a shaft 76 which moves within the spring 50. In one aspect the valve member 60 is formed on the piston 40 by molding thereon.

The valve member, piston, valve seat, piston guide, wear housing, nose guide, spring retainer, and sub body be made of polyurethane, aluminum, aluminum alloy, zinc, zinc alloy, stainless steel (e.g. SS316), plastic, composite, fiberglass, or metal. A set screw 84 may be used to attach the piston guide 30 to the shaft 76. Alternatively, one assembly may include the piston guide 30, piston 40, and shaft 76 and may be made of stainless steel. Such an assembly may also include the valve member 60. The piston 40 may be deleted and replaced with a solid valve member.

Figure 3A:
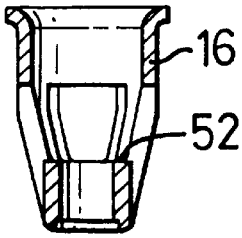
Figure 3B:
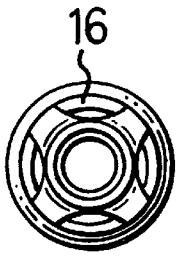

FIGS. 3A-1—show various parts of the valve assembly 10.

Figure 9:
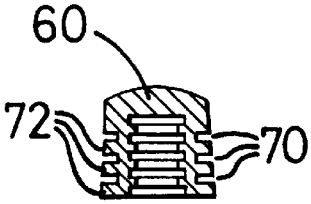
Figure 8:
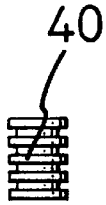
Figure 5:
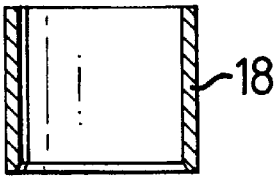
Figure 6A:
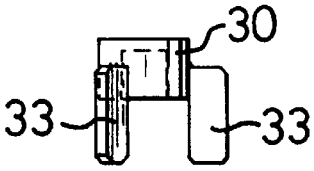
Figure 6B:
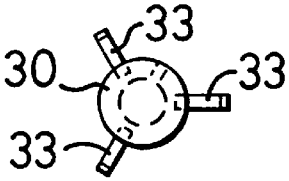
FIGS. 3B, 4B, and 6B are top views of the parts in FIGS. 3A, 4A and 6A respectively.
Figure 4A:
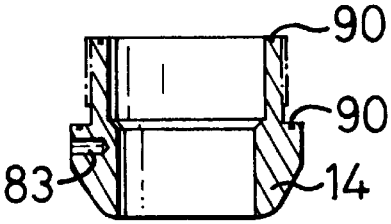
Figure 4B:
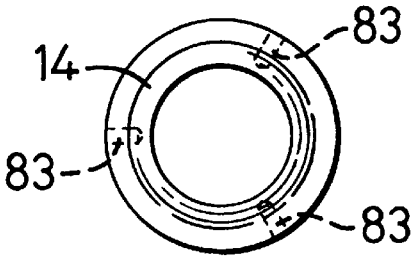

As shown in FIG. 2 and FIG. 9, the valve member 60 has three recesses 70 which encircle the valve member 60 (which itself is generally circular when viewed from above and below). In embodiments in which the valve member is made of flexible material, three recesses 70 define fins 72 which encircle the circular valve member 60 and which flex when pushed against the valve seat surface 62 of the valve seat 20. The lower recess 70 or the two lower recesses 70 or the upper and lower recess may be deleted. In another aspect the valve member 60 is made of rigid material and the recesses 70 capture debris. In another aspect the valve member 60 is made of flexible material and the recesses 70 capture debris. One, two, three or more such recesses may be used and they may be wider or narrower depending on the size recess and/or fin(s) desired. One, two, three or more fins may be employed and such a fin or fins may be disposed anywhere on the valve member. In certain aspects a single recess is used positioned at the top, at the bottom, or anywhere on the valve member body.

The valve seat surface 62 has a taper so that the valve seat's hollow interior is wider at the bottom and narrower at the top. The valve member 62 is correspondingly tapered exteriorly to mate with the taper of the seat surface 62 to enhance the sealing effect of the valve member 62 against the valve seat 20.

Figure 11:
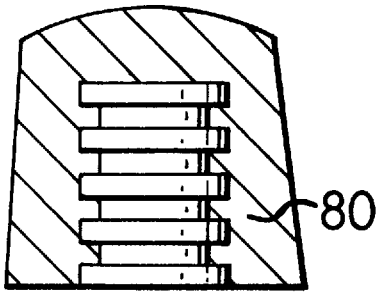
FIG. 11 is a side cross-section view of a valve member and piston according to the present invention.
Figure 12:
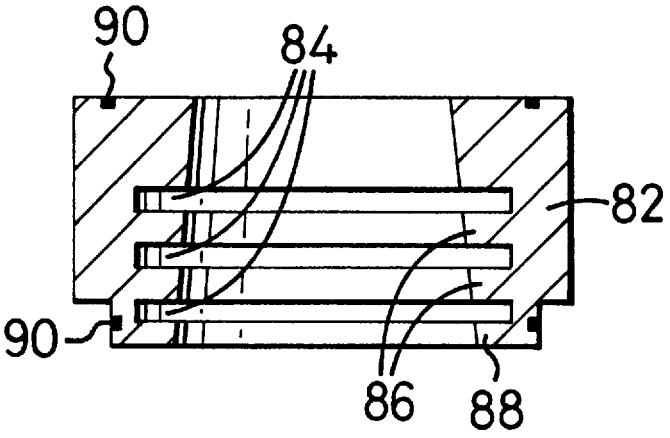
FIG. 12 is a side cross-section view of a valve seat according to the present invention.

FIG. 11 shows an alternative valve member 80 which has no recesses or fins. FIG. 12 shows an alternative valve seat 82 which has three recesses 84 that define two middle fins 86 and a top portion 88. It is within the scope of this invention to have a valve seat with one, two, three or more recesses and with one, two, three or more fins. It is also within the scope of this invention to have a valve assembly with a valve member 60 and a valve seat 82 with recess on the one aligned with recesses on the other or offset and/or with fins on one aligned with or offset from fins on the other. The valve seat 82 may be made of flexible or rigid material.

O-rings 90 seal the various interfaces between parts at which they are located.

Figure 13:
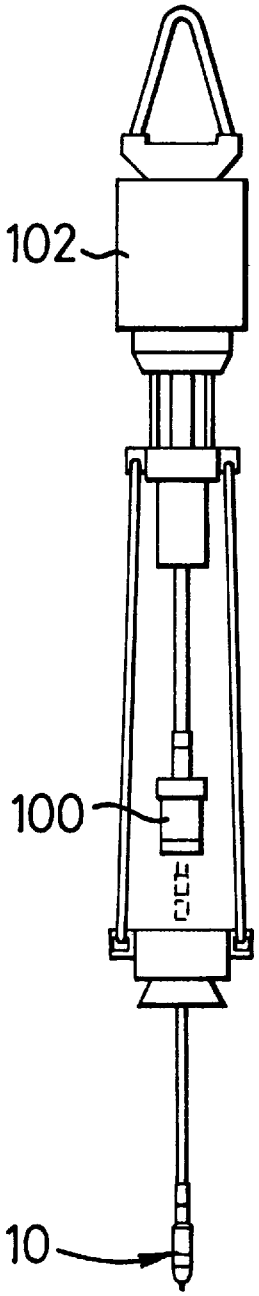
FIG. 13 is a schematic view of a system according to the present invention.

The valve assembly 10 may be used with a circulating head 100 (see e.g. FIG. 13) (e.g. but not limited to a LaFleur Autoseal Circulating Head) with the head interconnected above the mud saver assembly with or without an interconnected top drive 102. The mud saver assembly 10 is used in a method as is the "mud saver valve" as described in the LaFleur booklet submitted herewith which is incorporated fully herein for all purposes.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. §112.

What is claimed is:

1. A valve comprising a body through which fluid is flowable, a valve seat connected in and to the body and through which fluid is flowable, a valve member positioned adjacent the valve seat and selectively movable to seat against the valve to close the valve to fluid flow and selectively movable away from the seat to open the valve to fluid flow, and a plurality of spaced apart recesses on the valve member for holding debris and thereby preventing the debris from inhibiting valve closure.

2. The valve of claim 1 further comprising at least one of the plurality of recesses positioned near and end of the body defining at least one fin and the body is made of flexible material so the at least one fin is flexible to enhance sealing of the valve member against the valve seat.

3. The valve of claim 1 wherein at least one fin is defined between two adjacent recesses and the body is made of flexible material so the at least one fin is flexible to enhance sealing of the valve member against the valve seat.

4. The valve of claim 1 wherein the valve is a mud saver valve.

5. The valve of claim 4 in combination with a circulating head.

6. The valve of claim 5 wherein the valve is connected beneath and in fluid communication with the circulating head.

7. The valve of claim 6 further comprising a top drive, the circulating head connected to and below the top drive, the circulating head in fluid communication with the top drive.

8. The valve of claim 1 further comprising a plurality of stabilizing vanes extending out from a lower part of the valve member and projecting downwardly, each vane of the plurality of stabilizing vanes for stabilizing the valve member in the body.

9. The valve of claim 1 wherein the body, valve seat, and valve member are made of material from the group consisting of polyurethane, aluminum, aluminum alloy, zinc, zinc alloy, stainless steel, plastic, composite, fiberglass, and metal.

10. A valve comprising a body through which fluid is flowable, a valve seat connected in and to the body and through which fluid is flowable, a valve member positioned adjacent the valve seat and selectively movable to seat against the valve to close the valve to fluid flow and selectively movable away from the seat to open the valve to fluid flow, at least one recess on the valve seat for holding debris and thereby preventing the debris from inhibiting valve closure, wherein the at least one recess is a plurality of spaced apart recesses, wherein the valve is a mud saver valve, and further comprising a circulating head in combination with the valve.

11. The valve of claim 10 wherein the valve is connected beneath and in fluid communication with the circulating head.

12. The valve of claim 11 further comprising a top drive, the circulating head connected to and below the top drive, the circulating head in fluid communication with the top drive.

13. The valve of claim 10 further comprising a plurality of stabilizing vanes extending out from the lower part of the valve member and projecting downwardly, each vane of the plurality of stabilizing vanes for stabilizing the valve member in the body.

14. The valve of claim 10 wherein the body, valve seat, and valve member are made of material from the group consisting of polyurethane, aluminum, aluminum alloy, zinc, zinc alloy, stainless steel, plastic, composite, fiberglass, and metal.

15. A method for controllably moving fluid through a tubular string having a top portion in a rig and a bottom portion in a wellbore extending down into earth, the method comprising controlling flow of fluid in the tubular string with a valve, the valve comprising a body through which fluid is flowable, a valve seat connected in and to the body and through which fluid is flowable, a valve member positioned adjacent the valve seat and selectively movable to seat against the valve to close the valve to fluid flow and selectively movable away from the seat to open the valve to fluid flow, and a plurality of recesses on the valve member for holding debris and thereby preventing the debris from inhibiting valve closure.

16. A method for controllably moving fluid through a tubular string having a top portion in a rig and a bottom portion in a wellbore extending down into earth, the method comprising controlling flow of fluid in the tubular string with a valve, the valve comprising a body through which fluid is flowable, a valve seat connected in and to the body and through which fluid is flowable, a valve member positioned adjacent the valve seat and selectively movable to seat against the valve to close the valve to fluid flow and selectively movable away from the seat to open the valve to fluid flow, and at least one recess on the valve seat for holding debris and thereby preventing the debris from inhibiting valve closure, and wherein the fluid is wellbore cement.

17. A method for controllably moving fluid through a tubular string having a top portion in a rig and a bottom portion in a wellbore extending down into earth, the method comprising controlling flow of fluid in the tubular string with a valve, the valve comprising a body through which fluid is flowable, a valve seat connected in and to the body through which fluid is flowable, a valve member positioned adjacent the valve seat and selectively movable to seat against the valve to close the valve to fluid flow and selectively movable away from the seat to open the valve to fluid flow, and at least one recess on the valve seat for holding debris and thereby preventing the debris from inhibiting valve closure, wherein the at least one recess is a plurality of spaced apart recesses, wherein the valve is a mud saver valve, the valve further comprising a circulating head in combination with the valve, the valve connected beneath and in fluid communication with the circulating head, the valve further comprising a top drive, the circulating head connected to and below the top drive, the circulating head in fluid communication with the top drive, and wherein the fluid is drilling fluid and the rig is a drilling rig, and circulating fluid through the top drive, circulating head, and valve.

* * * * *